US008485846B2

(12) United States Patent
Jackson

(10) Patent No.: US 8,485,846 B2
(45) Date of Patent: Jul. 16, 2013

(54) INTEGRAL MOVEABLE SEALING MEMBER FOR FEED-THROUGH COAXIAL CABLE CONNECTORS

(75) Inventor: David H. Jackson, Manlius, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 22 days.

(21) Appl. No.: 13/233,057

(22) Filed: Sep. 15, 2011

(65) Prior Publication Data

US 2013/0072044 A1 Mar. 21, 2013

(51) Int. Cl.
*H01R 9/05* (2006.01)

(52) U.S. Cl.
USPC ..... 439/584

(58) Field of Classification Search
USPC ..... 439/584, 585, 578, 272, 589
See application file for complete search history.

(56) References Cited

U.S. PATENT DOCUMENTS 5,564,716 A * 10/1996 Onoue et al. ..... 277/607
6,193,549 B1 * 2/2001 Suzuki et al. ..... 439/589
7,422,463 B2 * 9/2008 Kuo ..... 439/349
7,819,694 B2 * 10/2010 Miyashita et al. ..... 439/585

* cited by examiner

*Primary Examiner* — Phuong Dinh
(74) *Attorney, Agent, or Firm* — Schmeiser, Olsen & Watts LLP

(57) ABSTRACT

A coaxial cable connector, comprising a post having a first end and a second end, the post configured to receive a coaxial cable having a protruding center conductor, a connector body attached to the post, a coupling member operably attached to the post, and a moveable sealing member disposed within the post, the moveable sealing member configured to move through the post to create a seal proximate the first end of the post is provided. Furthermore, associated methods are also provided.

23 Claims, 7 Drawing Sheets

INTEGRAL MOVEABLE SEALING MEMBER FOR FEED-THROUGH COAXIAL CABLE CONNECTORS

FIELD OF TECHNOLOGY

The following relates to connectors used in coaxial cable communication applications, and more specifically to embodiments of a connector having a moveable sealing member to prevent entry of moisture at the exposed end of the cable.

BACKGROUND

Standard feed-through type connectors for coaxial cables are typically connected onto complementary interface ports to electrically integrate coaxial cables to various electronic devices and to help prevent moisture entry to the exposed end of the cable. In some instances, the equipment port that the cable connector is fastened to lacks the ability to properly seal the connector and environmentally protect the exposed end of the cable. Moreover, moisture can migrate from the housing through the port and into the exposed end of the cable. However, nothing about the cable connector itself performs a sealing function to prevent ingress of environmental elements. Therefore, if the port is not equipped to properly seal the exposed end of the cable, moisture can enter the internals of the cable connector, which affects the efficiency and longevity of the cable, and leads to signal degradation.

Thus, a need exists for an apparatus and method for a coaxial cable connector which includes a sealing member to prevent ingress of environmental elements proximate the exposed end of the cable.

SUMMARY

A first general aspect relates to a coaxial cable connector, comprising a post having a first end and a second end, the post configured to receive a coaxial cable having a protruding center conductor, a connector body attached to the post, a coupling member operably attached to the post, and a moveable sealing member disposed within the post, the moveable sealing member configured to move through the post to create a seal proximate the first end of the post.

A second general aspect relates to a coaxial cable connector for connecting to an interface port comprising a post having a first end and a second end, the post configured to receive a coaxial cable having a center conductor, wherein the post includes an annular notch proximate the first end, a connector body attached to the post, a coupling member operably attached to the post, and a moveable sealing member disposed within the post proximate the second end, the moveable sealing member having an annular body, an opening proximate a center of the annular body, the opening configured to receive the center conductor, and a flap encircling the annular body.

A third general aspect relates to a coaxial cable connector, comprising a post having a first end and a second end, the post configured to receive a coaxial cable having a center conductor, wherein the post includes an annular notch proximate the first end, a connector body attached to the post, a coupling member operably attached to the post, and a means for effectuating a seal proximate the second end of the post, wherein the means includes displacing a moveable sealing member through the first end of the post and axially compressing the moveable sealing member into the annular notch of the post.

A fourth general aspect relates to a method of sealing an exposed end of a coaxial cable, comprising providing a post having a first end and a second end, the post configured to receive a protruding center conductor of the coaxial cable, a connector body attached to the post, a coupling member operably attached to the post, disposing a moveable sealing member within the post, inserting the coaxial cable into the post to displace the moveable sealing member through the first end of the post, and axially compressing the moveable sealing member into an annular notch of the post.

A fifth general aspect relates to a jumper comprising a first connector, wherein the first connector includes a post having a first end and a second end, the post configured to receive a coaxial cable having a protruding center conductor, a connector body attached to the post, a coupling member operably attached to the post, and a moveable sealing member disposed within the post, and a second connector, wherein the first connector is operably affixed to a first end of the coaxial cable, and the second connector is operably affixed to a second end of the coaxial cable.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
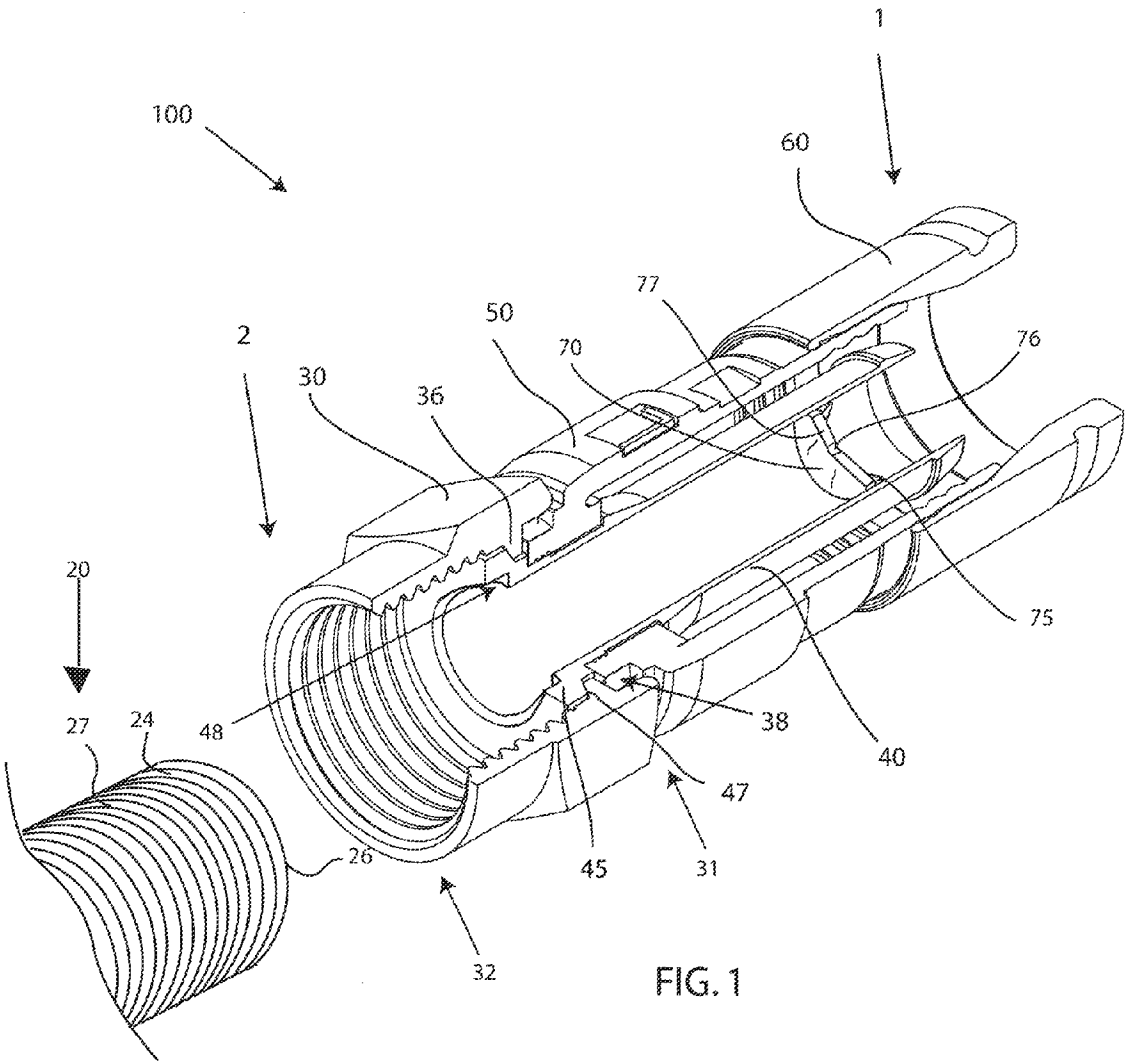
FIG. 1 depicts a perspective view of an embodiment of a coaxial cable connector.
Figure 8:
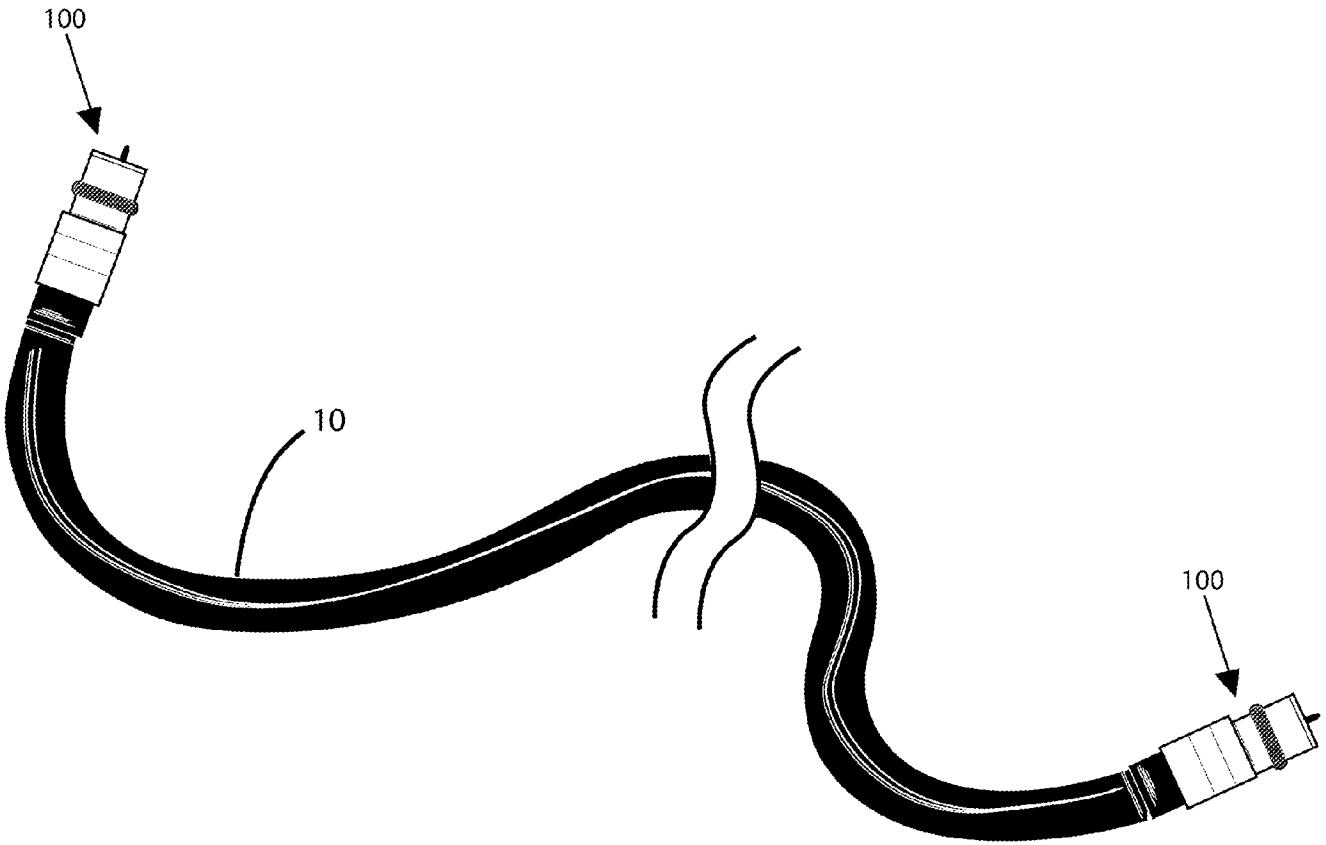
FIG. 8 depicts a perspective view of an embodiment of a jumper.

Referring to the drawings, FIG. 1 depicts an embodiment of a coaxial cable connector 100. A coaxial cable connector embodiment 100 has a first end 1 and a second end 2, and can be provided to a user in a preassembled configuration to ease handling and installation during use. Coaxial cable connector 100 may be any feed-through type cable connector, such as a F connector, or similar coaxial cable connector. A feed-through connector may be a connector used to mechanically integrate/join two more electrical paths. Two connectors, such as connector 100 may be utilized to create a jumper 300 that may be packaged and sold to a consumer, as shown in FIG. 8. Jumper 300 may be a coaxial cable 10 having a connector, such as connector 100, operably affixed at one end of the cable 10 where the cable 10 has been prepared, and another connector, such as connector 100, operably affixed at the other prepared end of the cable 10. Operably affixed to a prepared end of a cable 10 with respect to a jumper 300 includes both an uncompressed/open position and a compressed/closed position of the connector while affixed to the cable. For example, embodiments of jumper 300 may include a first connector including components/features described in association with connector 100, and a second connector that may also include the components/features as described in association with connector 100, wherein the first connector is operably affixed to a first end of a coaxial cable 10, and the second connector is operably affixed to a second end of the coaxial cable 10. Embodiments of a jumper 300 may include other components, such as one or more signal boosters, molded repeaters, and the like.

Figure 2:
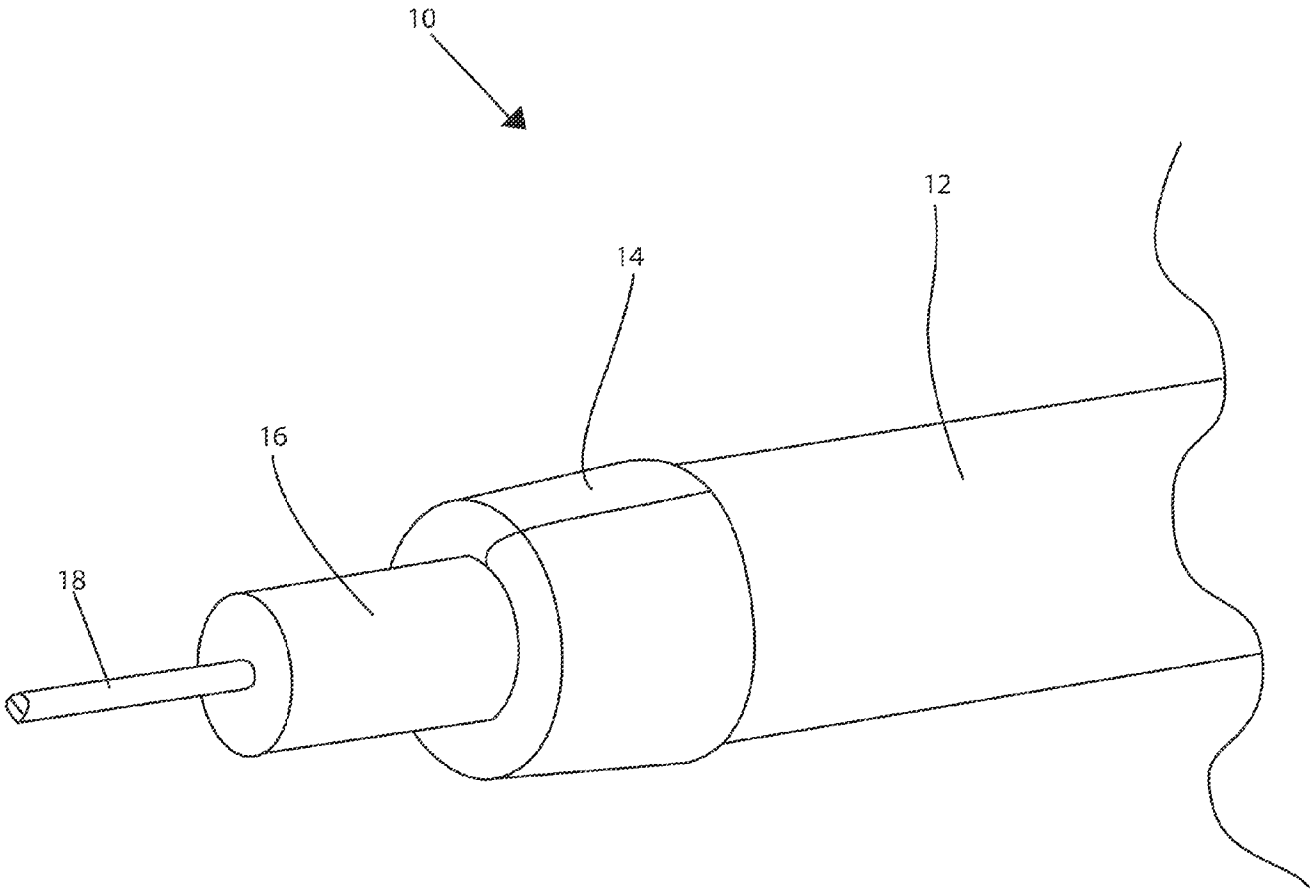
FIG. 2 depicts a perspective view of an embodiment of a coaxial cable.

Referring now to FIG. 2, the coaxial cable connector 100 may be operably affixed to a prepared end of a coaxial cable 10 so that the cable 10 is securely attached to the connector 100. The coaxial cable 10 may include a center conductive strand 18, surrounded by an interior dielectric 16; the interior dielectric 16 may possibly be surrounded by a conductive foil layer; the interior dielectric 16 (and the possible conductive foil layer) is surrounded by a conductive strand layer 14; the conductive strand layer 14 is surrounded by a protective outer jacket 12*a*, wherein the protective outer jacket 12 has dielectric properties and serves as an insulator. The conductive strand layer 14 may extend a grounding path providing an electromagnetic shield about the center conductive strand 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and center conductive strand 18. The prepared end of the coaxial cable, wherein the center conductive strand 18 extends a distance from the dielectric 16 and the jacket 12 is drawn back, may be referred to as an exposed end of the cable 10. The protective outer jacket 12 can physically protect the various components of the coaxial cable 10 from damage which may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. However, when the protective outer jacket 12 is exposed to the environment, rain and other environmental pollutants may travel down the protective outer jack 12. The conductive strand layer 14 can be comprised of conductive materials suitable for carrying electromagnetic signals and/or providing an electrical ground connection or electrical path connection. The conductive strand layer 14 may also be a conductive layer, braided layer, and the like. Various embodiments of the conductive strand layer 14 may be employed to screen unwanted noise. For instance, the conductive strand layer 14 may comprise a metal foil (in addition to the possible conductive foil) wrapped around the dielectric 16 and/or several conductive strands formed in a continuous braid around the dielectric 16. Combinations of foil and/or braided strands may be utilized wherein the conductive strand layer 14 may comprise a foil layer, then a braided layer, and then a foil layer. Those in the art will appreciate that various layer combinations may be implemented in order for the conductive strand layer 14 to effectuate an electromagnetic buffer helping to prevent ingress of environmental noise or unwanted noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Referring back to FIG. 1, the connector 100 may mate with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 24. However, various embodiments may employ a smooth surface, or partially smooth surface, as opposed to a completely threaded exterior surface. In addition, the coaxial cable interface port 20 may comprise a mating edge 26. It should be recognized that the radial thickness and/or the length of the coaxial cable interface port 20 and/or the conductive receptacle may vary based upon generally recognized parameters corresponding to broadband communication standards and/or equipment. Moreover, the pitch and depth of threads which may be formed upon the threaded exterior surface 24 of the coaxial cable interface port 20 may also vary based upon generally recognized parameters corresponding to broadband communication standards and/or equipment. The threads 24 may also include a working surface 27, which may be defined by the pitch and depth requirements of the port 20. Furthermore, it should be noted that the interface port 20 may be formed of a single conductive material, multiple conductive materials, or may be configured with both conductive and non-conductive materials corresponding to the port's 20 electrical interface with a coaxial cable connector, such as connector 100. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

Figure 3:
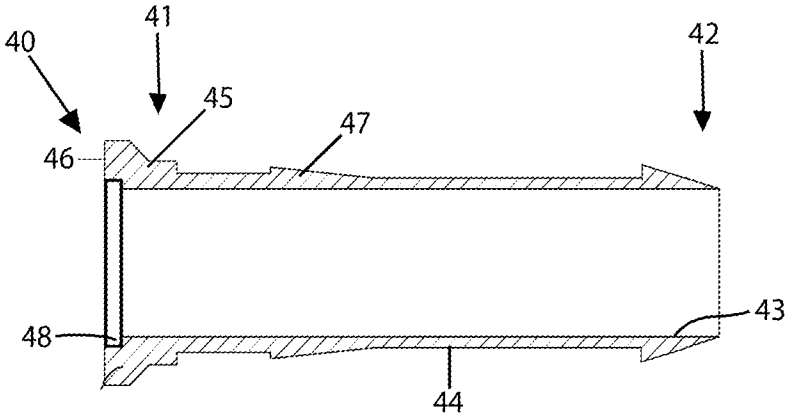
FIG. 3 depicts a cross-sectional view of an embodiment of a post.

Referring further to FIG. 1, and additional reference to FIG. 3, embodiments of a connector 100 may include a post 40, a coupling member 30, a connector body 50, a fastener member 60, and a moveable sealing member 70. Embodiments of connector 100 may also include a post 40 having a first end 41 and a second end 42, the post 40 configured to receive a coaxial cable 10 having a protruding center conductor 18, a connector body 50 attached to the post 40, a coupling member 30 operably attached to the post 40, and a moveable sealing member 70 disposed within the post 40, the moveable sealing member 70 configured to move through the post 40 to create a seal proximate the first end 41 of the post 40. Other embodiments of connector 100 may include a post 40 having a first end 41 and a second end 42, the post 40 configured to receive a coaxial cable 10 having a center conductor 18, wherein the post 40 includes an annular notch 48 proximate the first end 41, a connector body 50 attached to the post 40, a coupling member 30 operably attached to the post 40, and a moveable sealing member 70 disposed within the post 40 proximate the second end 42, the moveable sealing member 70 having an annular body 77, an opening 76 proximate a center of the annular body 77, the opening 76 configured to receive the center conductor 18, and a flap 75 encircling the annular body 77.

Embodiments of connector 100 may include a post 40. The post 40 comprises a first end 41, a second end 42, an inner surface 43, and an outer surface 44. Furthermore, the post 40 may include a flange 45, such as an externally extending annular protrusion, located proximate or otherwise near the first end 41 of the post 40. The flange 45 may include an outer tapered surface 47 facing the second end 42 of the post 40 (i.e. tapers inward toward the second end 42 from a larger outer diameter proximate or otherwise near the first end 41 to a smaller outer diameter. The outer tapered surface 47 of the flange 45 may correspond to a tapered surface of a lip 36 of the coupling member 30. Further still, an embodiment of the post 40 may include a surface feature such as a lip or protrusion that may engage a portion of a connector body 50 to secure axial movement of the post 40 relative to the connector body 50. However, the post 40 may not include such a surface feature, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge 26 of an interface port 20. The post 40 should be formed such that portions of a prepared coaxial cable 10 including the dielectric 16 and center conductor 18 can pass axially into the second end 42 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield or strand 14. Accordingly, where an embodiment of the post 40 may be inserted into an end of the prepared coaxial cable 10 under the drawn back conductive strand 14, substantial physical and/or electrical contact with the strand layer 14 may be accomplished thereby facilitating grounding through the post 40.

Figure 7:
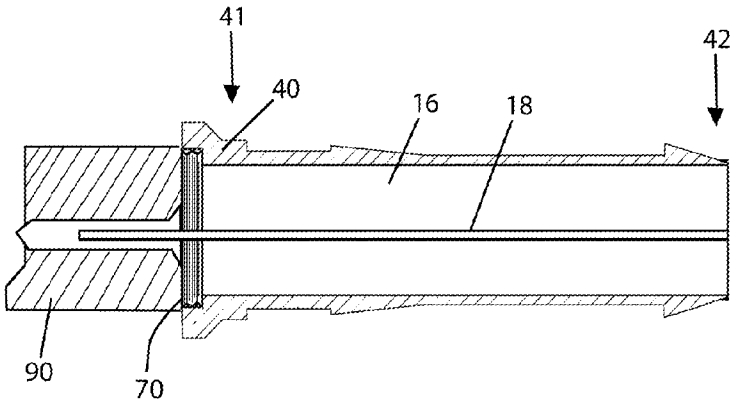
FIG. 7 depicts a cross-sectional view of an embodiment of the connector, wherein the moveable sealing member is in a sealing position.

Furthermore, the post 40 may include a notch 48 proximate the first end 41. For example, embodiments of the post 40 may include an annular notch 48 along an inner surface 43 of the post 40, proximate the flange 45 of the post 40. The notch 48 may have various cross-sections, including rectangular, square, and circular, to accommodate the moveable sealing member 70. Moreover, the notch 48 may be located at the first end 41 of the post 40, or may be positioned a short axial distance from the first end 41 of the post 40. Accordingly, the annular notch 48 may receive the moveable sealing member 70 when the connector 100 is in a compressed position (as shown in FIG. 7), wherein a flap edge 75 of the moveable sealing member 70 is fitted/crushed within the notch 48. Embodiments of the annular notch 48 of the post 40 may be a groove, channel, opening, tunnel, annular detent, annular cavity, and the like. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

With continued reference to FIG. 1, embodiments of connector 100 may include a coupling member 30. The coupling element 30 may be a nut, a threaded nut, port coupling element, rotatable port coupling element, and the like. The coupling element 30 may include a first end 31, second end 32, an inner surface 33, and an outer surface 34. The inner surface 33 of the coupling element 30 may be a threaded configuration, the threads having a pitch and depth corresponding to a threaded port, such as interface port 20. In other embodiments, the inner surface 33 of the coupling element 30 may not include threads, and may be axially inserted over an interface port, such as port 20. The coupling element 30 may be rotatably secured to the post 40 to allow for rotational movement about the post 40. The coupling element 30 may comprise an internal lip 36 located proximate the first end 31 and configured to hinder axial movement of the post 40. Furthermore, the coupling element 30 may comprise a cavity 38 extending axially from the edge of first end 31 and partial defined and bounded by the internal lip 36. The cavity 38 may also be partially defined and bounded by an outer internal wall 39. The coupling element 30 may be formed of conductive materials facilitating grounding through the coupling element 30, or threaded nut. Accordingly the coupling element 30 may be configured to extend an electromagnetic buffer by electrically contacting conductive surfaces of an interface port 20 when a coaxial cable connector, such as connector 100, is advanced onto the port 20. In addition, the coupling element 30 may be formed of non-conductive material and function only to physically secure and advance a connector 100 onto an interface port 20. Moreover, the coupling element 30 may be formed of both conductive and non-conductive materials. For example the internal lip 36 may be formed of a polymer, while the remainder of the coupling element 30 may be comprised of a metal or other conductive material. In addition, the coupling element 30 may be formed of metals or polymers or other materials that would facilitate a rigidly formed body. Manufacture of the coupling element 30 may include casting, extruding, cutting, turning, tapping, drilling, injection molding, blow molding, or other fabrication methods that may provide efficient production of the component. Those in the art should appreciate the various of embodiments of the nut 30 may also comprise a coupler member, or coupling element, having no threads, but being dimensioned for operable connection to a corresponding interface port, such as interface port 20.

Figure 4A:
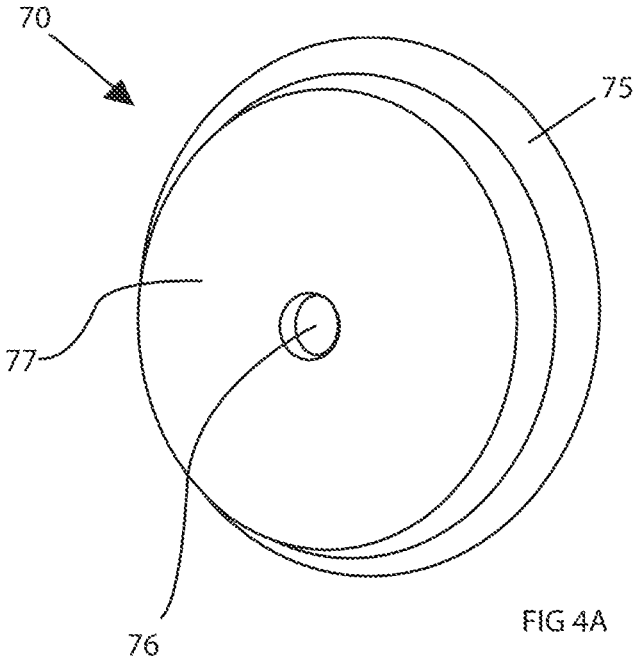
FIG. 4A depicts a perspective view of an embodiment of a moveable sealing member.
Figure 4B:
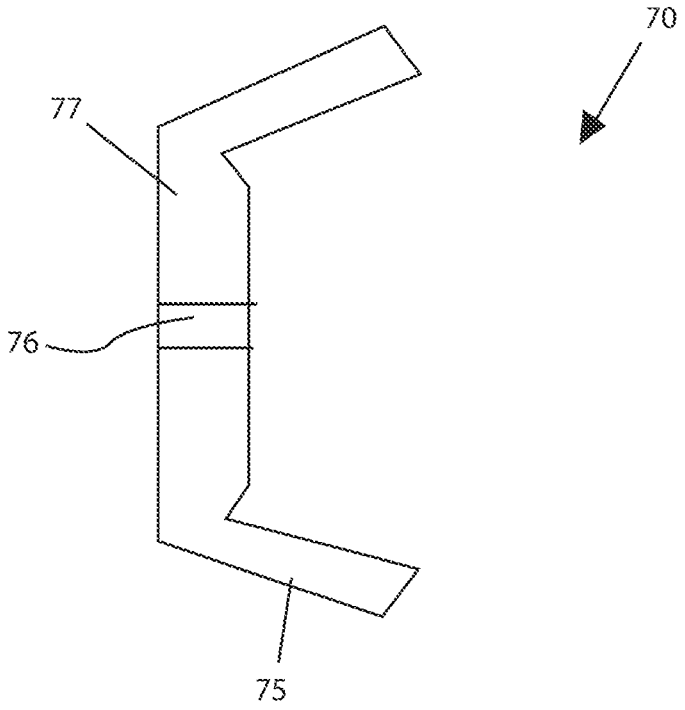
FIG. 4B depicts a cross-sectional view of an embodiment of the moveable sealing member.
Figure 5A:
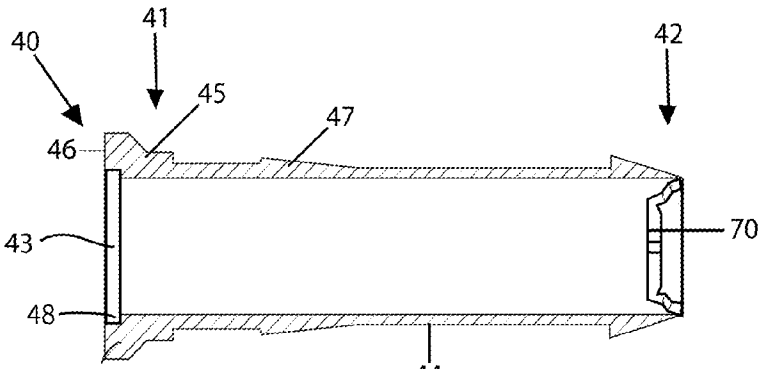
FIG. 5A depicts a cross-sectional view of an embodiment of the post with the moveable sealing member disposed within the post proximate a second end of the post, in a first position.
Figure 5B:
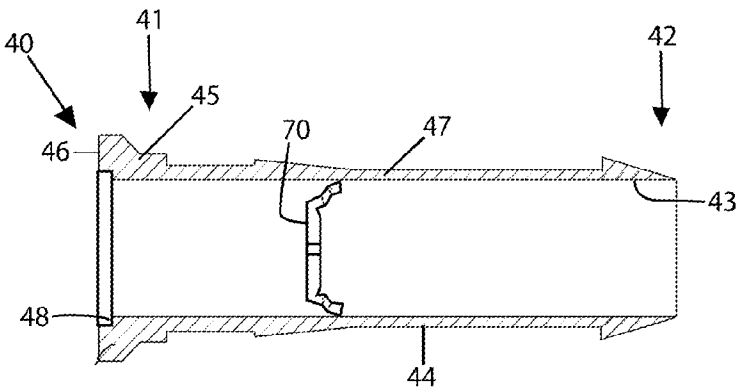
FIG. 5B depicts a cross-sectional view of an embodiment of the post with the moveable sealing member disposed within the post proximate a first end of the post, in the first position.

Referring now to FIGS. 1 and 4A-5B, embodiments of connector 100 may include a moveable sealing member 70. The moveable sealing member 70 may be disposed within/through the post 40, and may move, or be displaced, from a first position to a second position by a center conductor 18, and may be axially compressed into a sealing position. For example, the moveable sealing member 70 may be disposed within the generally axial opening of the post 40. The moveable sealing member 70 may be press-fit within the post 40, relying on an interference fit with the inner surface 43 of the post 40 to hold the moveable sealing member 70 in a first position (as shown in FIGS. 5A and 5B) until the cable 10 is inserted within the post 40 to displace the moveable sealing member 70 into a second position. In one embodiment, the moveable sealing member 70 may be disposed within the post 40 proximate or otherwise near the second end 42 of the post 40, as shown in FIG. 5A. As a cable 10 is inserted within the post 40 proximate the second end 42 of the post 40, the center conductor 18 of the cable 10 may engage the moveable sealing member 70 and drive the moveable sealing member 70 through the post 40. Because of the initial engagement between the moveable sealing member 70 and the center conductor 18 proximate the second end 42 of the post 40, the moveable sealing member 70 can act as a guide within the post 40 during installation. In an alternative embodiment, the moveable sealing member 70 may be disposed within the post 40 proximate or otherwise near the first end 41, or at any axial location within the post 40, as shown in FIG. 5B; however, it is possible that the further away the moveable sealing member 70 is placed away from the second end 42, the less effective the moveable sealing member 70 may be as a guide for the center conductor 18. Because the connector 100 may include a moveable sealing member 70 in a preassembled configuration in the field, the risk of ingress of environmental elements due to a port 20 having poor sealing functions is reduced because the connector 100 itself includes a sealing member that is placed into position following standard cable installation procedures, as described in greater detail infra.

Figure 6:
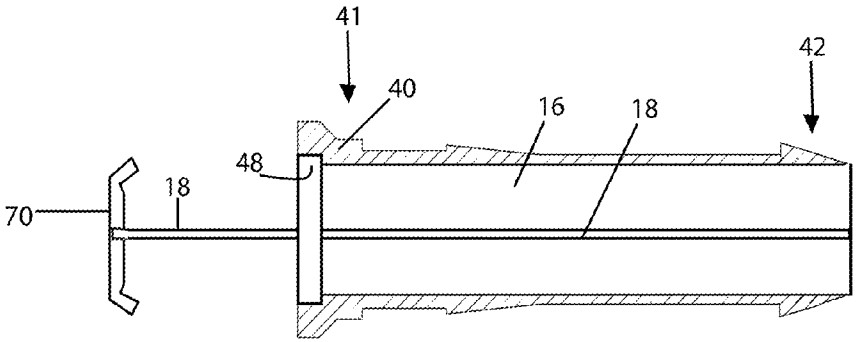
FIG. 6 depicts a cross-sectional view of an embodiment of the connector, wherein the moveable sealing member is in a second position.

Furthermore, embodiments of the moveable sealing member 70 may be a sealing plug, a disc, a disc-shaped seal, an annular plug, or any deformable member configured to be fitted within the post 40. Embodiments of the moveable sealing member 70 may include an annular body 77, an opening 76 proximate, or at, the center of the annular body 77, and a flap 75 that extends around the annular body 77, as shown in FIGS. 4A and 4B. Specifically, the moveable sealing member 70 may have a first diameter, $d_1$, a second diameter, $d_2$, and a third diameter, $d_3$. The first diameter, $d_1$, may measure, reflect, represent, etc. the size of an opening 76 in the moveable sealing member 70. The size of opening 76 should correspond with an incoming center conductor 18 of a coaxial cable 10. For instance, the size of the opening 76, or the size of the first diameter, $d_1$, should be slightly smaller than the size, including circumference and diameter, of the center conductor 18 of a coaxial cable 10 to allow the center conductor 18 to firmly engage and deform the moveable sealing member 70 proximate the opening 76. In most embodiments, the opening 76 is located at the center of the moveable sealing member 70; however, the location of the opening 76 should correspond to the location where the center conductor 18 will contact the moveable sealing member 70. When the coaxial cable 10 is fully inserted into the connector 100, as shown in FIG. 6, the center conductor 18 may engage and partially axially enter the opening 76 of the moveable sealing member 70 with a tight tolerance between the two components, so as to seal against the center conductive strand 18. In embodiments where the moveable sealing member 70 is formed of a malleable plastic, rubber, or similar resilient or flexible material, the size of the opening 76 of the moveable sealing member 70 may be slightly smaller than the center conductor 18 so that when the center conductor 18 engages the moveable sealing member 70 proximate the opening 76, portions of the moveable sealing member 70 proximate or otherwise near the opening 76 may deflect (as shown in FIG. 6). The deflection of portions of the moveable sealing member 70 may create a constant contact force against the center conductor 18 to establish and maintain continuous firm physical contact between the moveable sealing member 70 and the center conductor 18 as the cable 10 is inserted into the second end 42 of the post 40. Embodiments of opening 76 may be a through-hole, an opening, a bore, and the like, that extends through the annular body 77 of the moveable sealing member 70.

The second diameter, $d_2$, may measure, reflect, represent, etc. the size of the annular body 77. The annular body 77 can have a diameter that is slightly smaller than the inner diameter of the post 40. The third diameter, $d_3$, may measure, reflect, represent, etc. the size of the moveable sealing member 70 including the flap 75 extending around the annular body 77. Embodiments of flap 75 may be a continuous flexible edge that radially extends from the annular body 77. The third diameter, $d_3$, may be slightly larger than the inner diameter of the post 40 so that when the moveable sealing member 70 is disposed within the post 40, the flap 75 may deform and exert a biasing force against the inner surface 43 of the post 40. In some embodiments, the annular body 77 may slightly deflect when positioned within the post 40. The biasing force exerted onto the inner surface 43 of the post 40 due to the resilience of the flap 75 (and potentially the body 77) can create an interference fit between the post 40 and moveable sealing member 70. However, the force delivered to the moveable sealing member 70 from the incoming center conductor 18 and continued axial movement of the cable 10 towards the first end 41 of the post 40 is sufficient to displace/move the moveable sealing member 70 through the post 40. In other words, the moveable sealing member 70 may be held in place by the flexible continuous flap 75 that encircles the annular body 77, providing enough bias to prevent separation during handling, but permitting movement when an installer inserts the cable 10 within the connector 100. Embodiments of the sealing member may formed of materials exhibiting resilient properties, such as a malleable plastic, rubber, elastomer, polymer, and the like. For instance, the moveable sealing member 70 may made of polyethylene, polypropylene, silicone rubber, and the like. Those skilled in the art would appreciate that the moveable sealing member 70 may be fabricated by extruding, coating, molding, injecting, cutting, turning, elastomeric batch processing, vulcanizing, mixing, stamping, casting, and/or the like and/or any combination thereof in order to provide efficient production of the component.

Referring back to FIG. 1, embodiments of a coaxial cable connector, such as connector 100, may include a connector body 50. The connector body 50 may include a first end 51, a second end 52, an inner surface 53, and an outer surface 54. Moreover, the connector body may include a post mounting portion 57 proximate or otherwise near the first end 51 of the body 50; the post mounting portion 57 configured to securely locate the body 50 relative to a portion of the outer surface 44 of post 40, so that the connector body 50 is axially secured with respect to the post 40, in a manner that prevents the two components from moving with respect to each other in a direction parallel to the axis of the connector 100. In addition, the connector body 50 may include an outer annular recess 56 located proximate or near the first end 51 of the connector body 50. Furthermore, the connector body 50 may include a semi-rigid, yet compliant outer surface 54, wherein the outer surface 54 may be configured to form an annular seal when the second end 52 is deformably compressed against a received coaxial cable 10 by operation of a fastener member 60. The connector body 50 may include an external annular detent 58 located along the outer surface 54 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, embodiments of a coaxial cable connector 100 may include a fastener member 60. The fastener member 60 may have a first end 61, second end 62, inner surface 63, and outer surface 64. In addition, the fastener member 60 may include an internal annular protrusion located proximate the first end 61 of the fastener member 60 and configured to mate and achieve purchase with the annular detent 58 on the outer surface 54 of connector body 50. Moreover, the fastener member 60 may comprise a central passageway or generally axial opening defined between the first end 61 and second end 62 and extending axially through the fastener member 60. The central passageway may include a ramped surface 66 which may be positioned between a first opening or inner bore having a first inner diameter positioned proximate or otherwise near the second end 62 of the fastener member 60 and a second opening or inner bore having a larger, second inner diameter positioned proximate or otherwise near the first end 61 of the fastener member 60. The ramped surface 66 may act to deformably compress the outer surface 54 of the connector body 50 when the fastener member 60 is operated to secure a coaxial cable 10. For example, the narrowing geometry will compress squeeze against the cable, when the fastener member 60 is compressed into a tight and secured position on the connector body 50. Additionally, the fastener member 60 may comprise an exterior surface feature positioned proximate with or close to the second end 62 of the fastener member 60. The surface feature may facilitate gripping of the fastener member 60 during operation of the connector 100. Although the surface feature is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the coupling member 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

With reference now to FIGS. 5A-7, the manner in which the moveable sealing member 70 is displaced from a first position to a second position, and ultimately into a sealing position will now be described. FIGS. 5A and 5B depict an embodiment of connector 100 when the moveable sealing member 70 is located in a first position. The first position indicates when the moveable sealing member 70 is positioned within the post 40, for example, proximate or otherwise near the second end 42 of the post 40 (i.e. cable insertion end of the post 40). As an installer inserts a cable 10 into the second end 42 of the post 40, the center conductor 18 can engage the moveable sealing member 70 as described above and push/drive the moveable sealing member 70 towards the first end 41 of the post 40 (i.e. towards the coupling member 30) through the post 40 and to the second position. FIG. 6 depicts an embodiment of connector 100 when the moveable sealing member 70 is in the second position. In most embodiments, the second position of the moveable sealing member 70 is when the cable has been fully inserted within the post 40, and the moveable sealing member 70 is displaced through the first end 41 of the post 40 and/or beyond the post 40 an axial distance. For instance, when the cable 10 is fully inserted, the moveable sealing member 70 can push out the first end 41 of the post 40, but remain affixed to the protruding end of the rigid center conductor 18. Then, the moveable sealing member 70 can be forcefully pushed/driven over the center conductor 18 in a direction back towards the post 40 from the second position to a sealing position, effecting an interference fit with the center conductor 18 which is sufficient to seal, and can be further crushed into place within the notch 48 in the post 40 proximate the first end 41 of the post 40, as shown in FIG. 7. When the moveable sealing member 70 is driven, compressed, fitted, crushed, etc. into the notch 48 of the post 40, the flap 75 of the moveable sealing member 70 deforms against the edges of the notch 48, effecting a seal between the moveable sealing member 70 and the post 40 to prevent ingress of environmental elements, such as moisture and rainwater at the exposed end of the cable 10. In most embodiments, a plunger 90 of a compression tool drives the moveable sealing member 70 into the sealing position to provide a barrier against environmental elements proximate or otherwise near the first end 41 of the post 40. Accordingly, the exposed portion of the cable 10 can be capped and sealed using only one additional component (i.e. the moveable sealing member 70) compared to a standard feed-through type connector, while also providing a cable guide within the post 40 during insertion of the cable 10. Additionally, capping the cable end may not require special cable 10 preparation, insertion technique, or non-standard compression tools.

Referring to FIGS. 1-7, a method of sealing an exposed end of a coaxial cable may include the steps of providing a post 40 having a first end 41 and a second end 42, the post 40 configured to receive a protruding center conductor 18 of the coaxial cable 10, a connector body 50 attached to the post 40, a coupling member 30 operably attached to the post 40, disposing a moveable sealing member 70 within the post 40, inserting the coaxial cable 10 into the post 40 to displace the moveable sealing member 70 through the first end 41 of the post 40, and axially compressing the moveable sealing member 70 into an annular notch 48 of the post 40.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A coaxial cable connector, comprising:

a post having a first end and a second end, the post configured to receive a coaxial cable having a protruding center conductor;

a connector body attached to the post;

a coupling member operably attached to the post; and a moveable sealing member disposed within the post, the moveable sealing member configured to move through the post to create a seal proximate the first end of the post.

2. The coaxial cable connector of claim 1, wherein the moveable sealing member is disposed within the post proximate the second end of the post in a first position.

3. The coaxial cable connector of claim 1, wherein the moveable sealing member is displaced by the center conductor to a second position when the coaxial cable is inserted through the post.

4. The coaxial cable connector of claim 1, wherein the moveable sealing member is axially driven from a second position to a sealing position proximate the first end of the post.

5. The coaxial cable connector of claim 4, wherein a standard compression tool axially drives the moveable sealing member from the second position to the sealing position.

6. The coaxial cable connector of claim 1, wherein the post includes an annular notch proximate the first end of the post to receive the moveable sealing member in a sealing position.

7. The coaxial cable connector of claim 1, wherein the moveable sealing member is made of a resilient material.

8. The coaxial cable connector of claim 1, further comprising a fastener member radially disposed over the connector body to radially compress the connector body onto the coaxial cable.

9. A coaxial cable connector for connecting to an interface port comprising:

a post having a first end and a second end, the post configured to receive a coaxial cable having a center conductor, wherein the post includes an annular notch proximate the first end;

a connector body attached to the post;

a coupling member operably attached to the post; and a moveable sealing member disposed within the post proximate the second end, the moveable sealing member having an annular body, an opening proximate a center of the annular body, the opening configured to receive the center conductor, and a flap encircling the annular body.

10. The coaxial cable connector of claim 9, wherein the moveable sealing member biasingly engages an inner surface of the post proximate the second end.

11. The coaxial cable connector of claim 9, wherein the moveable sealing member is displaced through the post to effectuate a seal proximate the first end of the post.

12. The coaxial cable connector of claim 9, wherein portions of the moveable sealing member proximate the opening of the moveable sealing member are configured to seal against the center conductor.

13. The coaxial cable connector of claim 9, wherein the flap of the moveable sealing member is configured to deform within the annular notch of the post to prevent ingress of environmental elements after displacement through the post.

14. The coaxial cable connector of claim 9, wherein the moveable sealing member is made of a resilient material.

15. The coaxial cable connector of claim 9, further comprising a fastener member radially disposed over the connector body to radially compress the connector body onto the coaxial cable.

16. A coaxial cable connector, comprising:

a post having a first end and a second end, the post configured to receive a coaxial cable having a center conductor, wherein the post includes an annular notch proximate the first end;

a connector body attached to the post;

a coupling member operably attached to the post; and a means for effectuating a seal proximate the second end of the post;

wherein the means includes displacing a moveable sealing member through the first end of the post and axially compressing the moveable sealing member into the annular notch of the post.

17. A method of sealing an exposed end of a coaxial cable, comprising:

providing a post having a first end and a second end, the post configured to receive a protruding center conductor of the coaxial cable, a connector body attached to the post, a coupling member operably attached to the post;

disposing a moveable sealing member within the post;

inserting the coaxial cable into the post to displace the moveable sealing member through the first end of the post; and axially compressing the moveable sealing member into an annular notch of the post.

18. The method of claim 17, wherein the moveable sealing member is disposed proximate the second end of the post.

19. The method of claim 17, wherein the moveable sealing member is made of a resilient material.

20. The method of claim 17, wherein a standard compression tool axially compresses the moveable sealing member into the annular notch of the post.

21. The method of claim 17, wherein the moveable sealing member remains affixed to the center conductor when the moveable sealing member is displaced through the first end.

22. A jumper comprising:

a first connector, wherein the first connector includes a post having a first end and a second end, the post configured to receive a coaxial cable having a protruding center conductor, a connector body attached to the post, a coupling member operably attached to the post, and a moveable sealing member disposed within the post; and a second connector;

wherein the first connector is operably affixed to a first end of the coaxial cable, and the second connector is operably affixed to a second end of the coaxial cable.

23. The jumper of claim 22, wherein the second connector includes the same components as the first connector.

* * * * *